United States Patent [19]

Walker

[11] Patent Number: 4,551,917

[45] Date of Patent: Nov. 12, 1985

[54] KNIFE WITH LOCKING FOLDING BLADE

[76] Inventor: Michael L. Walker, Box 2343, Taos, N. Mex. 87571

[21] Appl. No.: 665,739

[22] Filed: Oct. 29, 1984

[51] Int. Cl.[4] ..... B26B 1/04

[52] U.S. Cl. ..... 30/161; 30/155

[58] Field of Search ..... 30/155, 156, 157, 160, 30/161, 159

[56] References Cited

U.S. PATENT DOCUMENTS

| | | | |
|---|---|---|---|
| 470,605 | 3/1892 | Schrade | 30/159 |
| 901,253 | 10/1908 | McVey | 30/159 |
| 1,087,788 | 2/1914 | Larsen | 30/159 |
| 4,133,106 | 1/1979 | Addis | 30/160 |
| 4,148,140 | 4/1979 | Lile | 30/161 |
| 4,170,061 | 10/1979 | Henry | 30/160 |
| 4,272,887 | 6/1981 | Poehlmann | 30/161 |
| 4,404,748 | 9/1983 | Wiethoff | 30/161 |

FOREIGN PATENT DOCUMENTS

| | | | |
|---|---|---|---|
| 549428 | 11/1942 | United Kingdom | 30/160 |

*Primary Examiner*—Jimmy C. Peters

*Attorney, Agent, or Firm*—Walter R. Keller

[57] ABSTRACT

A knife which has generally a blade and a handle wherein the blade folds into the handle; and wherein the handle has a first parallel plate and a second parallel plate which are secured to each other and spaced from each other by a spacer bushing and a fixed bushing to form therein a pocket into which the blade folds as it rotates around the fixed bushing. The fixed bushing has therein a slide hole into which the stem of a lock inserts. A biasing spring is installed in a bore in the stem and bears against a shoulder inside the stem and against a spring plate affixed to the outside of the first parallel plate, thereby biasing the stem and the lock through the second parallel plate. A button on the outside of the second parallel plate passes through a button hole therein, and the button is affixed to the end of the stem. The lock has a lock pin which protrudes through the first parallel plate and engages one of a plurality of lock pin holes in the blade securing the blade in the desired position. To release the blade, the button is pressed, thereby disengaging the lock pin from the lock pinhole and allowing the blade to be repositioned and again locked in the new desired position.

12 Claims, 4 Drawing Figures

KNIFE WITH LOCKING FOLDING BLADE

SUMMARY

Personal knives especially those which a person carries with him fall into several categories. Examples are pen knives, hunting knives and pocket knives. Folding knives have a requirement that the blade fold into the handle so that the sharp point and blade are not exposed when the blade is folded. Further, when the blade is folded, the blade must not be easily releaseable to avoid inadvertent release of the blade at an inopportune moment. When a folded blade is extended, the blade must be securely locked into position to avoid accidental folding and potential injury. Yet, with these requirements, it is highly desireable that the knife and handle be kept as thin as possible. The bulkier the knife or handle, the greater the difficulty in storing on one's person, or carrying in a pocket. It is also important that the means for controlling the knife blade be positive and accurate in its operation so that the risk of inadvertant operation is minimized.

It is therefore an object of the invention to provide a knife which meets the above requirements; and that those requirements are met by a means that is both reliable and economical.

DESCRIPTION OF THE PRIOR ART

1. Field of the Invention

The invention relates generally to knives which have blades that fold into the handle, and more particularly to knives that have blades which fold into the handle, and the blades are positively locked, or unlocked, by merely pressing a button.

2. Description of the Prior Art

Most folding knives are of a type which has a strong back spring lever which operates on a cam surface on the end of the blade affixed to the handle. The blade is manually opened against the pressure of the strong back spring, and when the cam surface of the blade is rotated sufficiently the strong back spring is biased to a semi-locked notch which, to a degree, prevents the blade from easily returning to the folded position. However the lock is not positive, and to fold an open blade, the user merely over powers the strong back spring and returns the blade to the closed position where the strong back spring again is biased to a semi-locked notch.

To overcome the deficiencies of the above described folding blade knife, positive lock blades have been developed. Poehlmann, U.S. Pat. No. 3,942,249 describes such a positive lock folding blade knife. Poehlmann essentially describes a method whereby a detent is shaped to fit in a uniquely shaped hole in the blade, when the blade is unlocked; or to fit in the uniquely shaped hole in the blade and a similarly shaped hole in one side of the handle at the same time when the blade is locked. Poehlmann's lock must be rotated with the blade when the blade is unlocked and is being rotated. In otherwords, the unlocking button of Poehlmann will be rotated when repositioning the blade. Furthermore, when Poehlmann's blade is unlocked and the blade is rotated, the detent also rotates causing the biasing spring therein to wear on the detent or on the spring retaining hub. Peohlmann's disclosure does however manage to enable a thin device, and a positive locking means.

DESCRIPTION OF THE PREFERRED EMBODIMENT

Figure 1:
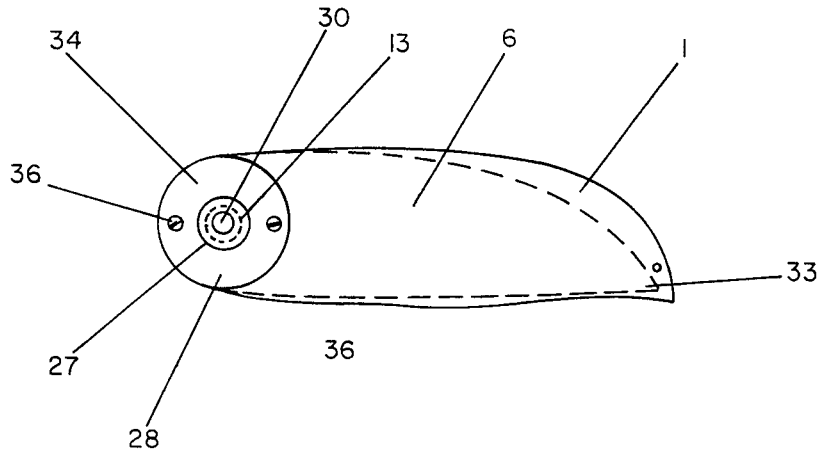
FIG. 1 is a side view of the knife with blade folded.
Figure 2:
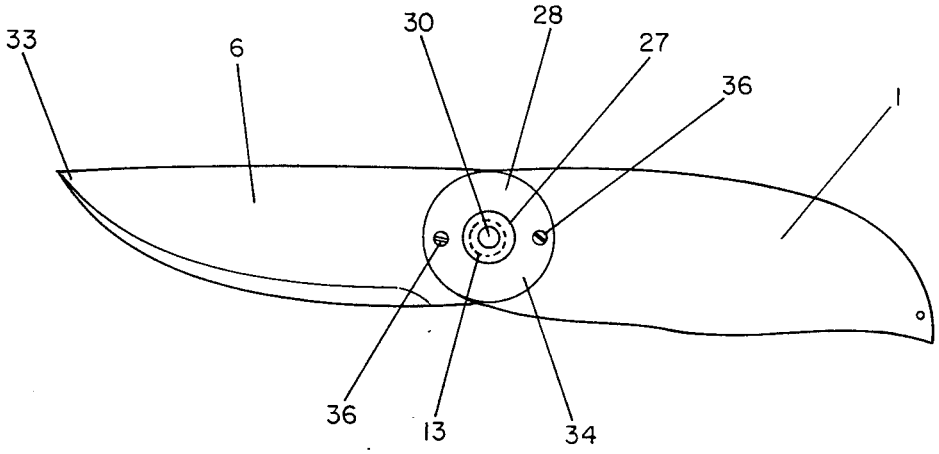
FIG. 2 is a side view of the knife with the blade extended.
Figure 3:
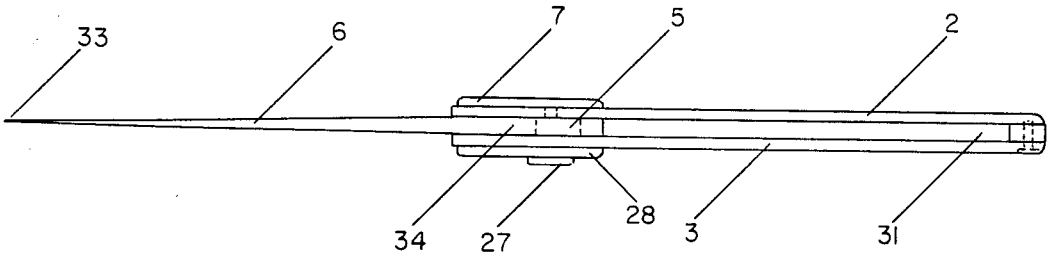
FIG. 3 is an edge view of the knife with blade extended.
Figure 4:
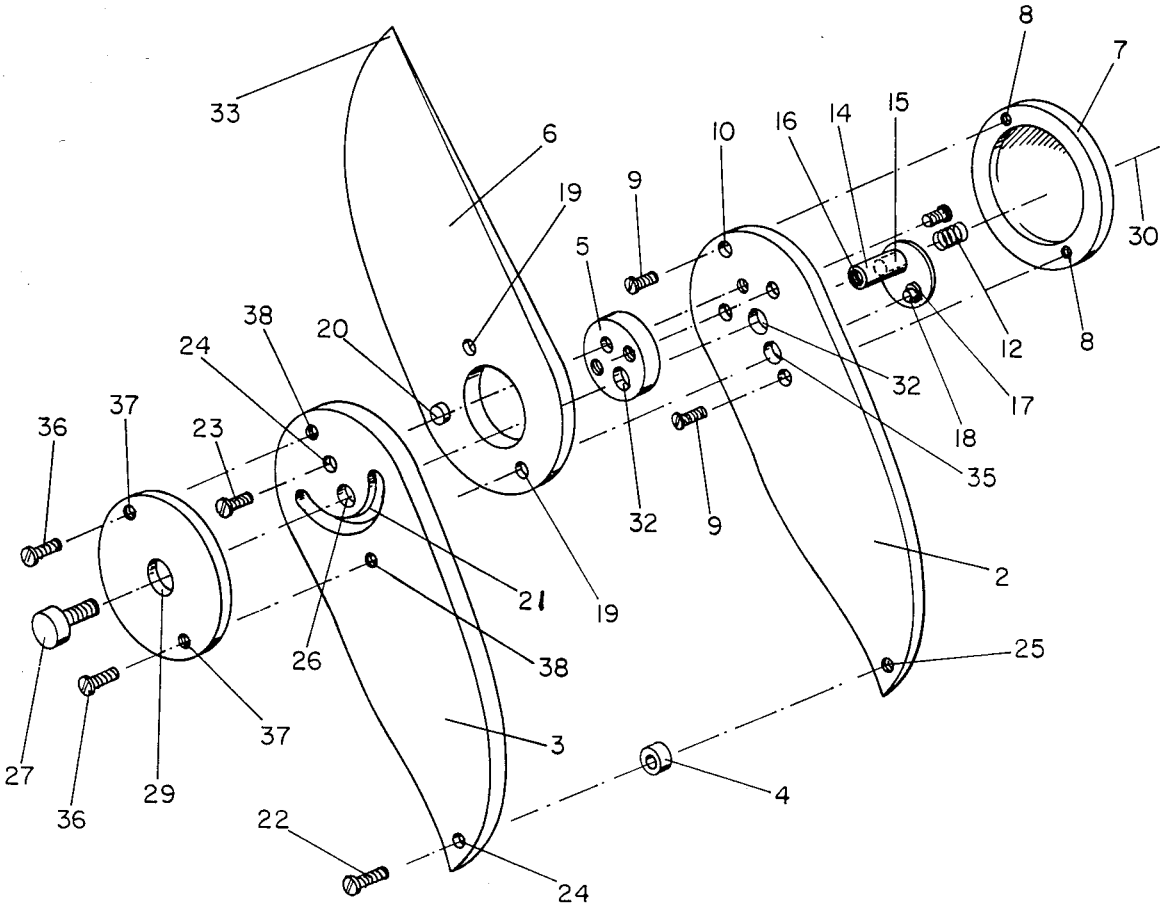
FIG. 4 is an isometric exploded view of the knife.

As shown in FIG. 1 through 4, a knife with a folding blade 6, has a handle generally shown as 1. The handle 1 has a first parallel plate 2 and a second parallel plate 3 which are assembled by means of a short assembly fastener 23 passing through an assembly hole 24 in the second parallel plate 3 and affixing to a fixed bushing 5, and a long assembly fastener 22 passing through an assembly hole 24 and then through a spacer bushing 4 and affixing to the first parallel plate 2. The fixed bushing 5 is made integral with, permanently attached to, or securely affixed to the first parallel plate 2 adjacent to one end of the handle 1. The assembly fasteners 22 and 23 are shown to be small bolts which thread into threaded bolt holes 25, however the fasteners could be any common means such as rivets. The fixed bushing 5 is circular and cylindrical and raised to a height approximately the thickness of the blade 6. The blade 6 has a point end 33 and a butt end 34. The general shape of the handle 1 must be such that it will contain the blade 6 in a pocket 31 formed by the separated but parallel plates 2 and 3. However the general shape of the blade 6 is determined by its function. Adjacent to the butt end 34, which is somewhat rounded, in the blade 6 is an aperture forming a right circular cylindrical bearing surface 13 sized to slideably fit over the fixed bushing 5. Thus when assembled between the first parallel plate 2 and the second parallel plate 3, the blade is free to rotate about the fixed bushing 5 and alternatively be extended from the handle 1 or contained in the pocket 31, or in any position in between. Through the fixed bushing 5 on its center and through the center of the circular cylindrical bearing surface 13 transverse and perpendicular to the parallel plates 2 and 3 is an axis, designated the transverse axis 30. The transverse axis 30 is the axis of rotation of the blade 6. Through the fixed bushing 5, through the first parallel plate 2 and with the center on the transverse axis 30, is a slide hole 32. A locking means, designated lock 11, has a stem 14 whose outside diameter is sized to slideably be inserted into the slide hole 32. The lock 11 is basically a thin flat plate having the stem 14, a right circular cylinder, rising from the plane of the flat plate of the lock 11. Also rising from the flat plate of the lock 11, on the same side of the flat plate, is a right circular cylindrical positioning stud 17. Rising from the positioning stud 17 is a right circular cylindrical lock pin 18. The lock pin 18 is the same diameter or smaller in diameter than the positioning stud 17; however the lock pin 18 and the positioning stud 17 are made integral with the flat plate of the lock 11, as is the stem 14. The stem 14 has a bore 15 which extends through the flat plate of the lock 11 but not through the free end of the stem 14. The free end of the stem 14 has therein a threaded button bolt hole 16. A biasing means, spring 12, is inserted into the bore 15 and compressed and retained in the bore 15 by a spring plate 7 which is fastened to the exterior of the first parallel plate 2 by any common means. As shown, the spring plate 7 is attached to the first parallel plate 2 by two screws 9 passing through the screw holes 10 in the first parallel plate 2 and into threaded screw holes 8 in the spring plate 7. The spring plate 7 is of sufficient size and shape to permit the lock 11 to be displaced sufficiently towards the spring plate 7 so that the lock pin 18 can be retracted from lock pin holes 19 in the blade 6. Adjacent to the fixed bushing 5, the first parallel plate 2 has another aperture, called a positioning hole 35. The positioning hole 35 is sized to slideably accept the positioning stud 17, and the positioning stud 17 is of sufficient height so it will not become disengaged fron the positioning hole 35 when the lock pin 18 is retracted from the blade 6. When the positioning stud 17 is fully inserted into the positioning hole 35, the lock pin 18 protrudes sufficiently to engage lock pin holes 19 in the butt end 34 of the blade 6. There are preferrably at least two lock pin holes 19 as shown in the blade 6, however there could be any number of lock pin holes 19 arranged on a circular arc around the transverse axis 30 in the blade 6, and this would enable the blade 6 to be locked in a multiplicity of different positions. The blade 6 has on its butt end 34 adjacent to the cylindrical bearing surface 13, a stop pin 20 which protrudes toward the second parallel plate 3. This stop pin 20 is sized in diameter and length to fit slideably into an arcuate slot 21 in the second parallel plate 3, yet not protrude beyond the second parallel plate 3. The arcuate slot 21 is a circular arcuate slot cut through the second parallel plate 3 and the center of the circular arcuate slot 21 is the transverse axis 30. The ends of the arcuate slot 21 are positioned so that the stop pin 20 bears only slightly against the ends of the arcuate slot 21 when the blade 6 is either fully extended or in the fully folded position. This provides a positive positioning when the blade is fully extended and in use, and further protects the sharp edge and point from folding too far into the pocket 31 and therein being damaged. On the transverse axis 30, the second parallel plate 3 has another aperature designated the button hole 26, and said button hole 26 is sized to slideably accept a lock release means shown as button 27. The button 27 is shaped generally as an ordinary round button with a stem which slides into the button hole 26. The stem of the button 27 is threaded on its extremity and threads into the threaded button bolt hole 16 in the stem 14 of the lock 11. Finally, a cover plate 28, having a button access hole 29 is secured to the outside of the second parallel plate 3 in such a manner that the button 27 protrudes through the button access hole 29. This cover plate 28 is primarily to cover the inner workings of the invention and to keep out contaminates such as dirt. The cover plate 28 is shown to be secured to the second parallel plate 3 by screws 36 which pass through screw holes 37 and thread into threaded screw holes 38.

When thus assembled, and assuming that the blade 6 is in the folded position and there locked, the spring 12 bears against the spring plate 7 and against the stem 14 causing the lock pin 18 to remain inserted in the lock pin hole 19 in the blade 6. The blade 6 is therefore positively locked in the folded position. The user, in order to release the blade 6, depresses the button 27 thereby depressing the stem 14 and compressing the spring 12. In turn, the lock pin 18 is withdrawn from the lock pin hole 19, while the positioning stud 17 remains engaged with the positioning hole 35. This frees the blade 6 which can be extended by manually repositioning the blade 6. Once the blade 6 has moved so that the locking pin 18 can no longer re-engage the same lock pin hole 19, the user can release the button 27 and the bias caused by the spring 12 will cause the lock pin 18 to bear against the butt end 34 of the blade 6. When the blade 6 extends fully the lock pin 18 will automatically engage the other lock pin hole 19 because of the bias from spring 12. When fully extended, the position of the blade 6 is made secure by both the lock pin 18 in the lock pin hole 19 and the stop pin 20 bearing slightly against the end of the arcuate slot 21. To close the blade 6 into the folded position again, the user merely depresses the button 27 and the mechanism repeats the functions with the blade 6 moving in a reverse direction. If there has been put into the blade 6 as aforestated, a multiplicity of lock pin holes 19, then the blade 6 can be intermediately positioned and locked there by the lock pin 18 being inserted into another lock pin hole, not shown.

It is obvious that the two parallel plates 2 and 3 could have affixed thereto on their exteriors any manner of decorative handle grips, not shown, which may also have functional purposes such for better grasping or holding. It is also obvious that the blade 6 may not have a sharp point and a cutting edge as is usually associated with a pocket knife, but may instead have any manner of tool or utensil as is common with multiple bladed knives.

I claim:

1. A knife comprising generally a handle and a blade wherein the handle is formed by a first parallel plate and a second parallel plate assembled so that the first parallel plate and the second parallel plate are spaced apart along a transverse axis, said parallel plates defining a pocket into which the blade will fold, a means defining a fixed bushing on the first parallel plate along the transverse axis toward the second parallel plate, and the blade having a point end and a butt end, and wherein there is a means for defining a bearing surface through the butt end of the blade, wherein said bearing surface is sized to slideably fit over the fixed bushing, thus enabling the blade when disposed over the fixed bushing between the parallel plates to rotate about the transverse axis and be positioned in the pocket, fully extended, or any intermediate position, and wherein the fixed bushing and the first parallel plate have a slide hole along the transverse axis and the first parallel plate has adjacent to the fixed bushing a positioning hole and wherein in the butt end of the blade, adjacent to the bearing surface, there are a multiplicity of lock pin holes, and wherein the centers of the lock pin holes, one at a time, and the center of the positioning hole are on a line parallel to the transverse axis as the blade is positioned from folded to extended, and wherein a locking means slideably inserts into the slide hole and the positioning hole from the exterior of the first parallel plate and wherein a biasing means bears against a spring plate affixed to the exterior of the first parallel plate, and the biasing means biases the locking means along the transverse axis toward the second parallel plate, and wherein the locking means is able to engage, through the positioning hole, an aligned lock pin hole in the butt end of the blade, and wherein the second parallel plate has along the transverse axis a button hole through which a lock release means passes and the lock release means engages the locking means whereby the lock release means may be activated against the biasing means removing the locking means from the lock pin hole allowing the blade to be freely repositioned, and wherein releasing the lock release means enables the biasing means to insert the locking means into any aligned lock pin hole.

2. The knife of claim 1 wherein the locking means comprises a flat plate having thereon a stem, said stem having an outside diameter sized to slideably fit into the slide hole, and said stem having, through the flat plate, a bore sized to accept the biasing means, said bore extending up into said stem but not through the free end of the stem, and said flat plate of the locking means having, adjacent to the stem, a positioning stud protruding in the same direction as the stem, and said positioning stud being sized to slideably fit into the positioning hole in the first parallel plate, and the positioning stud having mounted thereon a lock pin, said lock pin being sized to protrude into one of the lock pin holes when the lock pin hole is aligned with the lock pin.

3. The knife of claim 1 wherein the blade has a stop pin protruding from the butt end, adjacent to the bearing surface, toward and into a circular arcuate slot in the second parallel plate, and wherein the arcuate slot has ends positioned so that when the blade is locked by the locking means in the lock pin hole in either the full extended or fully folded position, the stop pin bears slightly against the ends of the arcuate slot.

4. The knife of claim 2 wherein the blade has a stop pin protruding from the butt end, adjacent to the bearing surface, toward and into a circular arcuate slot in the second parallel plate, and wherein the arcuate slot has ends positioned so that when the blade is locked by the locking means in the lock pin hole in either the full extended or fully folded position, the stop pin bears slightly against the ends of the arcuate slot.

5. The knife of claim 1 wherein the biasing means is a helical spring which bears against the locking means and the spring plate.

6. The knife of claim 2 wherein the biasing means is a helical spring which bears against the spring plate, said helical spring being sized to slideably fit into the bore of the stem of the locking means.

7. The knife of claim 1 wherein the lock release means is a button with a stem which is sized to slideably fit the button hole in the second parallel plate, and the stem of the button being threaded and mated to the locking means.

8. The knife of claim 2 wherein the lock release means is a button with a stem which is sized to slideably fit the button hole in the second parallel plate, and the stem of the button being threaded and mated to the locking means.

9. The knife of claim 1 wherein there are only two lock pin holes in the blade, corresponding to the fully extended position and the fully folded position.

10. The knife of claim 2 wherein there are only two lock pin holes in the blade, corresponding to the fully extended position and the fully folded position.

11. The knife of claim 1 wherein a cover plate is secured to the outside of the second parallel plate, and wherein the cover plate has therein a button access hole through which the lock release means protrudes.

12. The knife of claim 2 wherein a cover plate is secured to the outside of the second parallel plate, and wherein the cover plate has therein a button access hole through which the lock release means protrudes.

* * * * *